United States Patent [19]

Meadows

[11] 4,233,790

[45] Nov. 18, 1980

[54] EXTRUSIONS AND BUILDING STRUCTURES

[75] Inventor: David F. Meadows, Milton, W. Va.

[73] Assignee: DoNel Corporation, Mt. Vernon, Ohio

[21] Appl. No.: 1,593

[22] Filed: Jan. 8, 1979

Related U.S. Application Data

[63] Continuation-in-part of Ser. No. 807,492, Jun. 17, 1977, abandoned.

[51] Int. Cl.[3] ..... A47H 13/00

[52] U.S. Cl. ..... 52/222; 52/716; 24/213 R; 24/216; 160/395

[58] Field of Search ..... 52/222, 202, 203, 63, 52/716 R; 24/213 R, 216; 160/395

[56] References Cited

U.S. PATENT DOCUMENTS

| | | | |
|---|---|---|---|
| 2,042,726 | 6/1936 | Maeller | 160/394 |
| 3,068,939 | 12/1962 | Commisso | 24/243 K |
| 3,205,547 | 9/1965 | Riekse | 160/392 |
| 3,363,390 | 1/1968 | Crane | 52/716 |
| 3,371,702 | 3/1968 | Keegan | 24/243 K |
| 3,392,498 | 7/1968 | Rogers | 52/395 |
| 4,133,367 | 1/1979 | Abell | 160/392 |
| 4,164,105 | 8/1979 | Herbst | 52/202 |

FOREIGN PATENT DOCUMENTS

| | | | |
|---|---|---|---|
| 1352750 | 1/1964 | France | 24/243 K |
| 910194 | 11/1962 | United Kingdom | 52/222 |

*Primary Examiner*—James A. Leppink
*Assistant Examiner*—H. E. Raduazo
*Attorney, Agent, or Firm*—Sidney W. Millard

[57] ABSTRACT

A one piece extrusion for use in the manufacturing of structures including structures such as frames, wall partitions, display boards, signs, covers, filters, screens, mesh, window sash and window-like structures, such window frames, window sash and other structures and methods of making such structures and especially of making window sash. The extrusion comprises a locking element of which the main portion is formed of a substantially rigid plastic material, which is provided with spaced integral, flexible projections extending angularly outwardly from the stem of the element, and which is adapted to be inserted in a channel formed in the entire periphery of a rectangular frame so as to hold a flexible translucent, transparent, or opaque sheet locked in the channel. The flexible sheet is forced into the channel. In so doing the flexible sheet is stretched to give a smooth appearance and is locked in the channel and sealed by the extrusion.

1 Claim, 7 Drawing Figures

EXTRUSIONS AND BUILDING STRUCTURES

PRIOR APPLICATIONS

This is a continuation-in-part of copending application Ser. No. 807,492, filed June 17, 1977, now abandoned.

BACKGROUND OF THE INVENTION

1. Field of the Invention

The invention disclosed herein relates to buildings and to the construction field. More specifically it relates to the construction and use of assembled frames which are provided with and/or are adapted to receive separate releasable portions of the frame. One obvious use of the invention is in connection with windows for a building. Such windows may be storm windows as well as more permanent installations. Not only is the invention valuable in connection with windows but may be useful in connection with other framed portions of a building such as doors, etc. The invention relates to the complete window construction as well as to its several components and also to methods of providing such construction and components. The invention is especially characterized by an extrusion of moldable plastic having a rigid portion and integral flexible locking and sealing projections or flanges.

SUMMARY OF THE INVENTION

The invention relates to the formation of an extruded plastic locking and sealing member for use in the construction industry for sealing and locking a sheet of transparent or translucent or even opaque flexible plastic to a frame in order to form a window or other similar building component. The frame has a channel extending around the periphery thereof into which the several edges of the flexible plastic sheet may be forced by the locking and sealing member. The locking and sealing member is of extruded plastic such as polyvinyl chloride and has the main body, which may be T-shaped in cross section formed of unplasticized polyvinyl chloride and is therefore rigid. However, it has flexible flanges or projections formed integral with the rigid main body but formed of plasticized polyvinyl chloride so that the flanges may bend to allow the locking and sealing member to move into the channel of the frame and to push the edges of the flexible sheet into the channel ahead of the locking and sealing member and so to lock the sheet in the groove and seal the whole frame.

It is clear that there is need for a device to cooperate with flexible sheets in the design and construction of frames, windows, doors and similar structures useful in building operations.

Therefore, one object of the invention is the provision of a one piece extrusion which is a holding and locking means, which may be generally T-shaped in cross section, which is designed and adapted to be moved into a channel formed in a frame and in so doing forcing into said channel portions of a flexible sheet, stretching such sheet, and holding and locking said portions of the flexible sheet in said channel.

A further object of the invention is the provision of a one piece extrusion having the main portion formed of rigid plastic, and also having flexible projections formed integrally with said main portion.

A further object of the invention is the provision of a window sash including a rectangular frame with a channel formed around its entire periphery; a flexible sheet, which may be transparent or translucent, having its sides inserted in the channel of the frame; and locking and sealing members holding the sides of the sheet in the channel and locking the sides of the sheet in the channel and sealing the sheet to the frame to prevent the passage of air therethrough.

A feature of my invention is that the flexible film may be removed without substantial damage and stored and thereafter reused if desired.

Further objects and features of the invention include methods of manufacturing building components including frames with removable transparent or translucent sheets secured thereto and locked in place by an extruded element having a rigid portion and flexible projections.

Further objects and features of the invention should be apparent from the following description of a preferred embodiment and from the appended claims.

BRIEF DESCRIPTION OF THE DRAWINGS

Following is a brief description of the drawings.

DESCRIPTION OF THE PREFERRED EMBODIMENT

Figure 1:
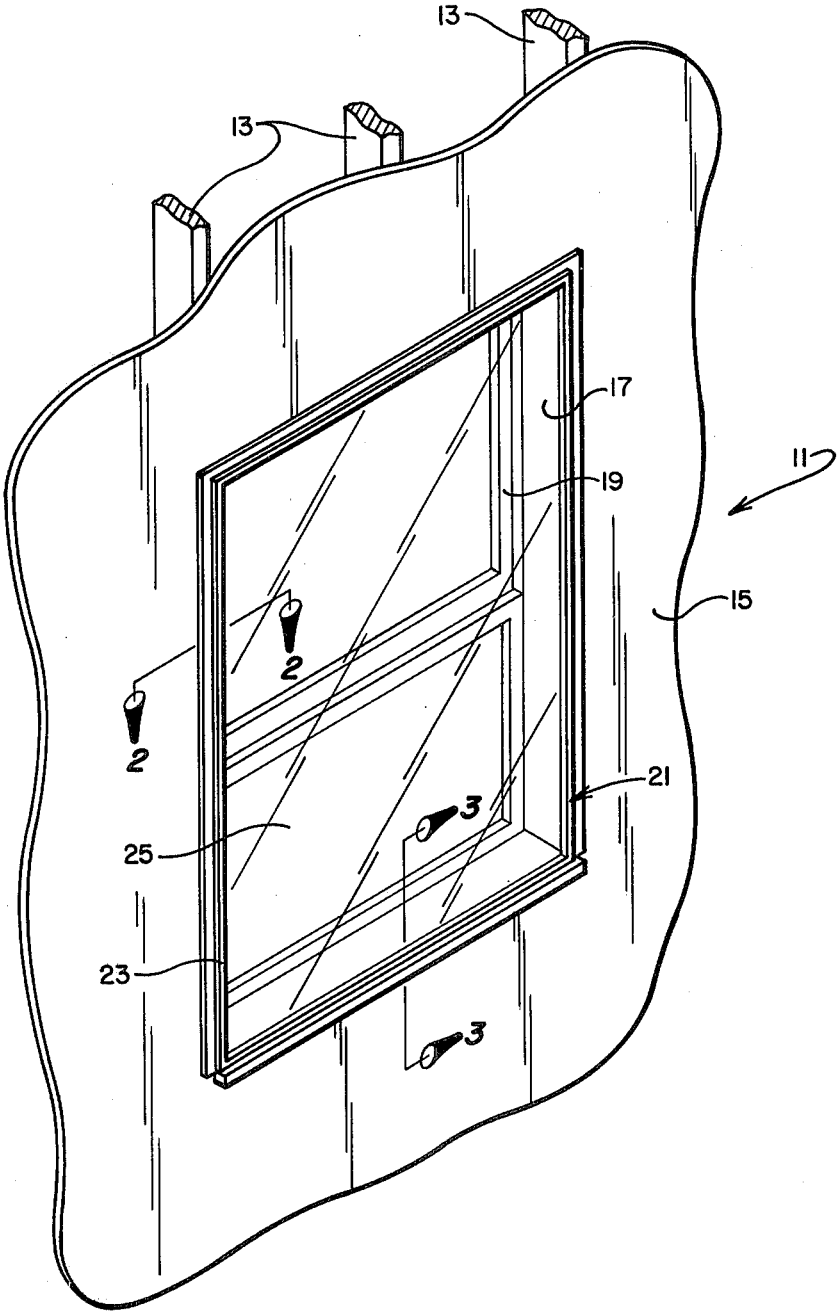
FIG. 1 is a fragmentary view in perspective of a portion of a building having a window and having a storm window constructed according to my invention secured to the frame of said window but spaced from said window to provide an air space.

Referring now to FIG. 1, I have illustrated the embodiment by a building 11 having uprights 13 to which a sidewall 15 is secured. In the sidewall 15 there is inserted a structural frame 17 for a window 19. Also secured to the structural frame 17 is a storm window 21 constructed according to my invention. The storm window 21 includes an outer frame 23 formed of sides 22 and ends 24 and a sheet of flexible plastic 25 overlaying the entire frame 23.

Figure 2:
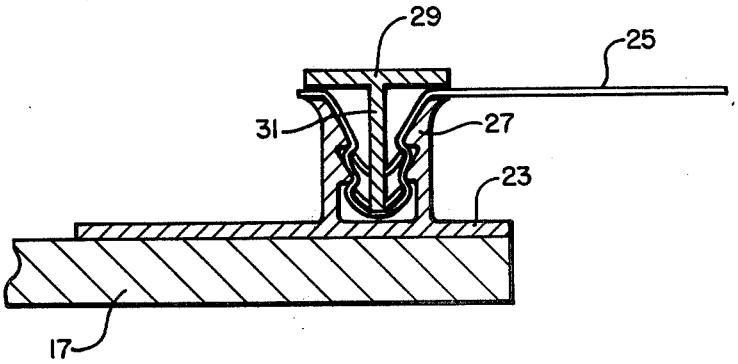
FIG. 2 is a view in cross section taken substantially on the line 2—2 of FIG. 1.
Figure 3:
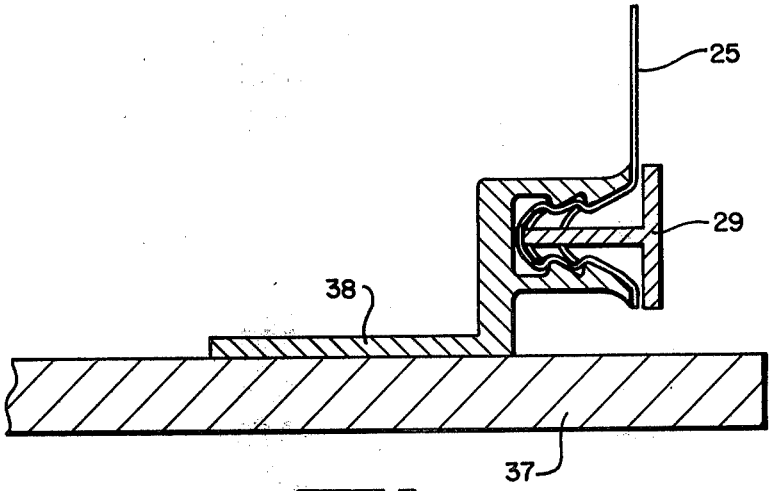
FIG. 3 is a view in cross section taken substantially on the line 3—3 of FIG. 1.
Figure 4:
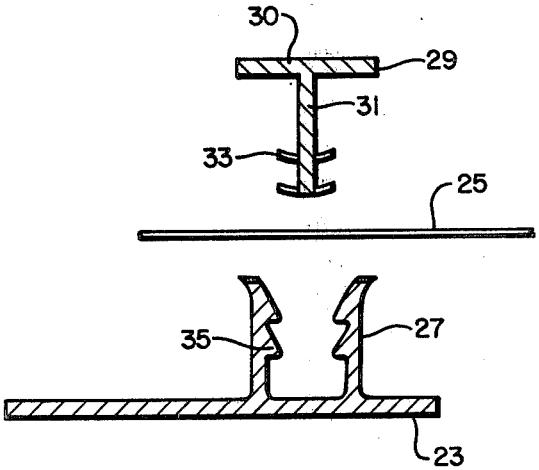
FIG. 4 is a fragmentary exploded view showing in section the components of the outer frame of FIGS. 1 and 2 prior to assembly of the components into locking and sealing relationship.

As shown in FIGS. 2 and 3 the outer frame 23 is secured to the structural frame 17. The frame 23 may be secured as by nailing and is provided with channel members 27 each formed with a channel extending around the entire periphery of the frame 23. Here it should be stated that channels such as the channels in channel members 27 may be formed in the structural frame 17 or even in other structural parts of the building. The flexible sheet 25 which may preferably be translucent or transparent, overlays the entire frame 23 and its edges are forced by locking members such as member 29 into the entire channel formed in channel members 27. Although a single locking member may be formed designed to fit in the entire channel 27 surrounding the entire frame 23, I prefer to provide a separate locking member for each side of the frame. It is possible to use two or more locking members for any side of the frame but I prefer to have one locking member such as 29 for each side of the frame. The locking member 29 is shown to have a main body which is T-shaped in cross section but the main body may be of several different shapes as for example, it could have different shapes of the head or have no head at all. I prefer that it have a head 30 and a stem 31. The head 30 overlays the mouth of channel member 27. The stem 31 of the T is formed mainly of rigid plastic but it is also formed with a plurality of integral flexible projections or flanges 33 extending outward from the stem 31. These flexible projections 33 are as best seen in FIG. 4, of a thickness lesser than the stem 31 and are inclined toward the head 30 of the T so as to facilitate the entrance of the locking member 29 into the channel of channel member 27 and to resist the withdrawal of the locking member therefrom. Nevertheless, by the exercise of force, the members 29 may be withdrawn to disassemble the window 21 when and if desired.

The channel in channel member 27 is formed with teeth 35 (see especially FIG. 4) to further resist the withdrawal of the locking member 29 from the channel of channel member 27 while allowing the relatively easy insertion of the locking member 29 into the channel of channel member 27. The tips of channel members 27 may be flexible as shown at 26 and 28. This helps sealing and minimizes tearing.

Where as is usually the case, the frame 17 is formed with a sill such as sill 37, shown in FIG. 3, the shape of the channel member is changed. For example it may have the shape of the channel member 38 as shown in FIG. 3. One edge of the flexible transparent sheet 25 is forced into the channel of channel member 38 by the locking member 29 in the same manner as described above in connection with the channel in channel member 27.

ALTERNATIVE EMBODIMENTS

Figure 5:
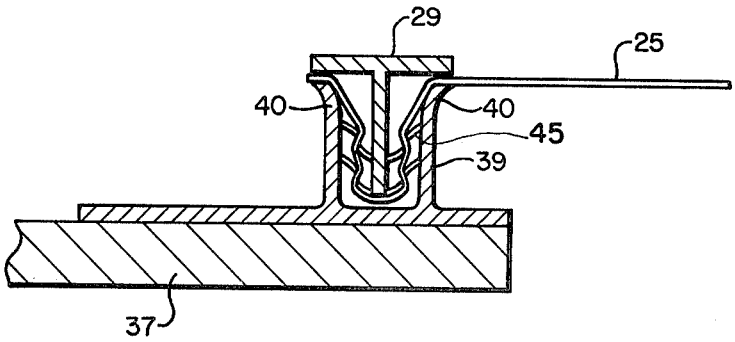
FIG. 5 is a view in section similar to FIG. 2 but showing a modified form of channel.

In FIG. 5 I have shown an alternative form of channel member 39. Channel member 39 has a channel which has no ridge or teeth such as the teeth 35 but it has integral flexible flanges such as flanges 45. Even these can be dispensed with if desired and the interior of the channel of channel member 39 may be perfectly smooth. Flexible sheet 25 cooperates with the channel in channel member 39 and the locking member as it cooperates with channel member 27 and locking member 29. Note however that member 39 is provided with flexible tips 40 to help sealing and to minimize tearing of film 25.

Figure 6:
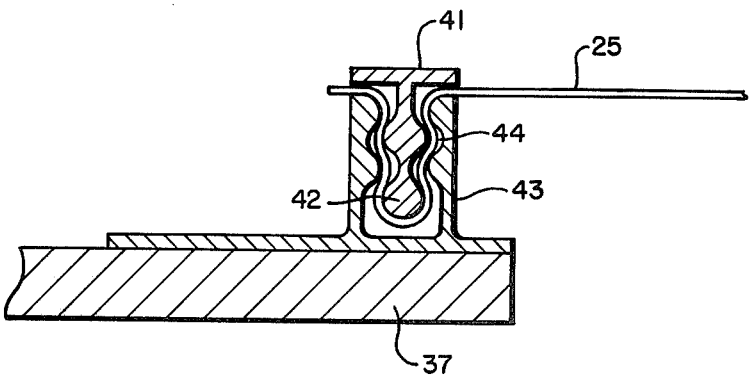
FIG. 6 is a view in section similar to FIG. 2 but showing modified forms of a channel member and a locking member.

In FIG. 6. I have shown an alternative form of locking member 41 and an alternative form of channel member 43. Locking member 41 is formed with a plurality of flexible balls or bars 42. The channel member 43 is rigid and is formed with a plurality of grooves 44 complementing the bars 42 of the locking member 41.

Figure 7:
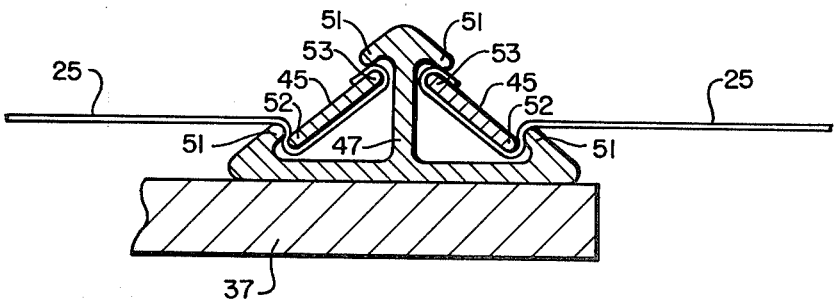
FIG. 7 is a view in section similar to FIG. 2 but showing modified forms of a channel member and of locking member.

In FIG. 7, I have shown an alternative form of locking member 45 and an alternative form of channel member 47. The members 45 and 47 may be wholly rigid or may have flexible tips as at 51, 52 and 53.

OPERATION

The frame 23 is formed of a pair of side members 22 and a pair of end members 24. Each of the side members 22 and each of the end members is formed with a channel such as the channel in channel member 27. The flexible member 25 (preferably transparent) is placed over the frame 23 and over the channels formed in the side members 22 and the end members 24. Locking members 29 are forced into the channels and force the edges of the sheet 25 ahead into the channels thus stretching the sheet 25 and sealing the joints between the frame 23 and the sheet 25 thus providing an effective storm window. When the storm window is not needed, the sheet 25 may be removed by pulling out the locking members 29, thus releasing the sheet 25. The frame 23 may be left secured to the structural frame 17, if desired. The sheet 25 may be stored for reuse.

It is to be understood that the above described embodiments of my invention are for the purpose of illustration only and various changes may be made therein without departing from the scope of the appended claims.

What is claimed is:

1. A window-like structure comprising:

a plurality of rigid side and end members secured together in perpendicular and parallel relationship to form a frame and arranged to be secured to a building structure, the ends of said members being mitered and united together, each of said members of said frame being formed with channels which combine to form a channel positioned around the periphery of said frame, said channel including teeth projecting inwardly from its sides;

a sheet of flexible plastic material spreading over all of said side and end members;

a plurality of locking members, one of which is inserted in each of said channels, forcing a portion of said flexible sheet into said channels and stretching, sealing, holding, and locking said sheet to said frame in said channels;

said locking members being each formed as a one piece extrusion having a generally T-shape in cross section with a stem and a head both of which are formed of substantially rigid plastic material and which has both sides of the stem of the T provided with integral spaced angularly and outwardly extending projections of plastic material substantially more flexible than the substantially rigid material of the main section of the T and integrally united with the substantially rigid material of the main section of the T, said projections having a thickness less than the stem and being inclined from the stem toward the head;

the width of the channel between the crests of the teeth being less than the width between the outer ends of the projections, the teeth and projections combining to lock the sheet in place.

* * * * *